US010125766B2

(12) United States Patent
Tanito et al.

(10) Patent No.: US 10,125,766 B2
(45) Date of Patent: Nov. 13, 2018

(54) UNIAXIAL ECCENTRIC SCREW PUMP

(71) Applicant: HEISHIN Ltd., Hyogo (JP)

(72) Inventors: Atsushi Tanito, Kobe (JP); Takashi Sato, Kobe (JP)

(73) Assignee: HEISHIN LTD., Hyogo (JP)

( * ) Notice: Subject to any disclaimer, the term of this patent is extended or adjusted under 35 U.S.C. 154(b) by 116 days.

(21) Appl. No.: 15/033,078

(22) PCT Filed: Oct. 16, 2014

(86) PCT No.: PCT/JP2014/077565
§ 371 (c)(1),
(2) Date: Apr. 28, 2016

(87) PCT Pub. No.: WO2015/064372
PCT Pub. Date: May 7, 2015

(65) Prior Publication Data

US 2016/0245285 A1 Aug. 25, 2016

(30) Foreign Application Priority Data

Oct. 29, 2013 (JP) ..... 2013-224415

(51) Int. Cl.
*F01C 1/10* (2006.01)
*F04C 15/00* (2006.01)
*F04C 2/107* (2006.01)

(52) U.S. Cl.
CPC ..... *F04C 15/0065* (2013.01); *F04C 2/1075* (2013.01); *F04C 2230/60* (2013.01); *F04C 2240/805* (2013.01)

(58) Field of Classification Search
CPC ..... F04C 2240/805; F04C 15/0065; F04C 2230/60; F04C 2/1075
See application file for complete search history.

(56) References Cited

U.S. PATENT DOCUMENTS 3,642,307 A * 2/1972 Brickhouse ..... F16L 37/1205 285/24
3,838,949 A * 10/1974 Makino ..... F04C 2/1073 418/153

(Continued)

FOREIGN PATENT DOCUMENTS

CN 101146999 A 3/2008
CN 202449811 U 9/2012

(Continued)

*Primary Examiner* — Audrey K Bradley
*Assistant Examiner* — Anthony Ayala Delgado
(74) *Attorney, Agent, or Firm* — Baker & Hostetler LLP

(57) ABSTRACT

Provided is a uniaxial eccentric screw pump which includes: a casing having a first locking receiving portion; a stator connected to the casing and having an inner peripheral surface which is formed into a female threaded shape; a rotor being insertable into the stator 8 and formed of a shaft body having a male threaded shape; an end stud having a second locking receiving portion and connected to the stator on a side opposite to the casing; and a holder being configured to hold the stator between the casing and the end stud. The holder includes: a first locking portion lockable to the first locking receiving portion of the casing; a second locking portion lockable to the second locking receiving portion of the end stud; and an adjusting portion capable of adjusting a distance between the first locking portion and the second locking portion.

10 Claims, 10 Drawing Sheets

(56) References Cited

U.S. PATENT DOCUMENTS

| | | | | |
|---|---|---|---|---|
| 7,871,253 | B2 * | 1/2011 | Kreidl | F04C 2/1071<br>417/313 |
| 8,439,659 | B2 * | 5/2013 | Loeker | F04C 2/1075<br>418/45 |
| 2008/0008611 | A1 | 1/2008 | Kreidl et al. | |

FOREIGN PATENT DOCUMENTS

| | | | |
|---|---|---|---|
| JP | H03-032184 | A | 3/1991 |
| JP | 2004-353605 | A | 12/2004 |
| JP | 2005-344585 | A | 12/2005 |
| JP | 2008-533385 | A | 8/2008 |
| JP | 2012-017660 | A | 1/2012 |
| WO | WO 2006/099842 | A1 | 9/2006 |

* cited by examiner

UNIAXIAL ECCENTRIC SCREW PUMP

CROSS-REFERENCE TO RELATED APPLICATIONS

This is a national phase application of International Patent Application No. PCT/JP2014/077565, filed Oct. 16, 2014, which claims priority to Japanese Patent Application No. 2013-224415, filed Oct. 29, 2013, the disclosures of which are incorporated herein by reference in their entireties.

TECHNICAL FIELD

The present invention relates to a uniaxial eccentric screw pump.

BACKGROUND

Conventionally, as a uniaxial eccentric screw pump, there has been known a uniaxial eccentric screw pump which includes: a male-threaded rotor which is directly connected to an output shaft; and a stator which is rotatably supported in the inside of a housing by means of a bearing, has a rotational axis arranged eccentrically from a rotational axis of the rotor, and has female-threaded inner surface (see Japanese Unexamined Patent Publication No. 2012-17660, for example).

However, in the above-mentioned conventional uniaxial eccentric screw pump, the housing is configured such that a suction portion and a discharge portion are fastened to both end portions of a body portion of the housing by bolts respectively. The stator housed in the inside of the housing is a resin-made non-durable part and hence, it is necessary to periodically exchange the stator. In this case, an operation of dismounting the suction portion and the discharge portion from the body portion by loosening the bolts, and mounting the suction portion and the discharge portion on the body portion thereafter is bothersome and cumbersome.

SUMMARY

Problems To Be Solved

It is an object of the present invention to provide a uniaxial eccentric screw pump where a stator which is a non-durable part can be exchanged easily and rapidly.

Means For Solving The Problems

The present invention provides, as a means for solving the problems, a uniaxial eccentric screw pump which includes: a casing having a first locking receiving portion; a stator connected to the casing and having an inner peripheral surface which is formed into a female threaded shape; a rotor being insertable into the stator and formed of a shaft body having a male threaded shape; an end stud having a second locking receiving portion and connected to the stator on a side opposite to the casing; and a holder being configured to hold the stator between the casing and the end stud, wherein the holder includes: a first locking portion lockable to the first locking receiving portion of the casing; a second locking portion lockable to the second locking receiving portion of the end stud; and an adjusting portion capable of adjusting a distance between the first locking portion and the second locking portion.

With such a configuration, by merely increasing the distance between the first locking portion and the second locking portion by using the adjusting portion, the first locking portion can be separated from the first locking receiving portion and, at the same time, the second locking portion can be separated from the second locking receiving portion so that the stator can be removed from the rotor.

Also, in exchanging the stator with a new stator, by locking the first locking portion to the first locking receiving portion of the casing and by locking the second locking portion to the second locking receiving portion of the end stud in a state where the rotor is inserted into the center hole of the stator, the stator can be held between the casing and the end stud by the holder. Then, by performing fastening for narrowing the distance between the first locking portion and the second locking portion by using the adjusting portion, the stator can be fixed between the casing and the end stud.

It is preferable that the first locking receiving portion be a first flange portion formed on the casing and have a first groove on a surface thereof on a side opposite to the stator, and the first locking portion have at least a first locking pawl lockable to the first groove.

With such a configuration, by locking the first locking pawl into the first groove, a locking state of the first locking portion of the holder to the first flange portion of the casing can be made stable. Accordingly, a stator holding state before the fastening by using the adjusting portion is performed is improved and hence, a fastening operation can be performed smoothly.

It is preferable that the second locking receiving portion be a second flange portion formed on one end side of the end stud and have a second groove on a surface thereof on a side opposite to the stator, and the second locking portion have a second locking pawl lockable to the second groove.

With such a configuration, by locking the second locking pawl into the second groove, a stator holding state before the fastening by using the adjusting portion is performed is further improved so that the fastening operation can be performed smoothly.

It is preferable that the stator be arranged such that an axis of the stator agrees with a vertical direction, and the casing is arranged above the stator.

With such a configuration, by forming a groove portion only on the first flange portion of the casing and by forming the locking pawl only on the first locking portion of the holder, a holding state before a fastening operation is performed by using the adjusting portion can be made more stable.

It is preferable that the holder be formed of a plurality of holders, the locking pawl of the first locking portion be formed into an arcuate shape, a groove portion of the first flange portion be formed into a circular shape which allows locking of the locking pawl into the groove portion, and the locking pawls arranged adjacently to each other be brought into contact with each other in a state where the locking pawls of the respective holders are locked into the groove portion.

With such a configuration, the positional relationship between the holders around the stator can be decided and hence, the fastening can be performed in a well-balanced manner.

It is preferable that the holder be formed of two holders, and the locking pawls be formed respectively within a range of 180 degrees.

It is preferable that the adjusting portion of the holder include: male threaded portions formed on both end sides of the adjusting portion respectively or female threaded portions formed on both end sides of the adjusting portion respectively such that threading directions of the male threaded portions or threading directions of the female threaded portions are set opposite to each other; and a rotation operating portion formed on a middle portion of the adjusting portion.

With such a configuration, by merely operating the rotation operating portion, the distance between the first locking portion and the second locking portion can be simultaneously adjusted by using the adjusting portion and hence, operability can be further improved.

EFFECT OF THE DISCLOSURE

According to the present invention, in a state where the rotor is inserted into the inside of the stator, the first locking portion is locked to the first locking receiving portion of the casing, and the second locking portion is locked to the second locking receiving portion of the end stud. Accordingly, mounting and removing operations of the stator can be performed efficiently.

BRIEF DESCRIPTION OF THE DRAWINGS

The foregoing and the other feature of the present invention will become apparent from the following description and drawings of an illustrative embodiment of the invention in which.

DETAILED DESCRIPTION

Hereinafter, embodiments according to the present invention are described by reference to attached drawings. In the description made hereinafter, terms indicating specific directions and positions (terms including "upper", "lower", "side", and "end", for example) are used when necessary. However, these terms are used for facilitating the understanding of the invention described by reference to the drawings, and the technical scope of the present invention is not limited by the meaning of these terms. Further, the description made hereinafter essentially only exemplifies examples of the present invention, and the description is not intended to limit the present invention, a product to which the present invention is applied, or the application of the present invention.

Figure 1:
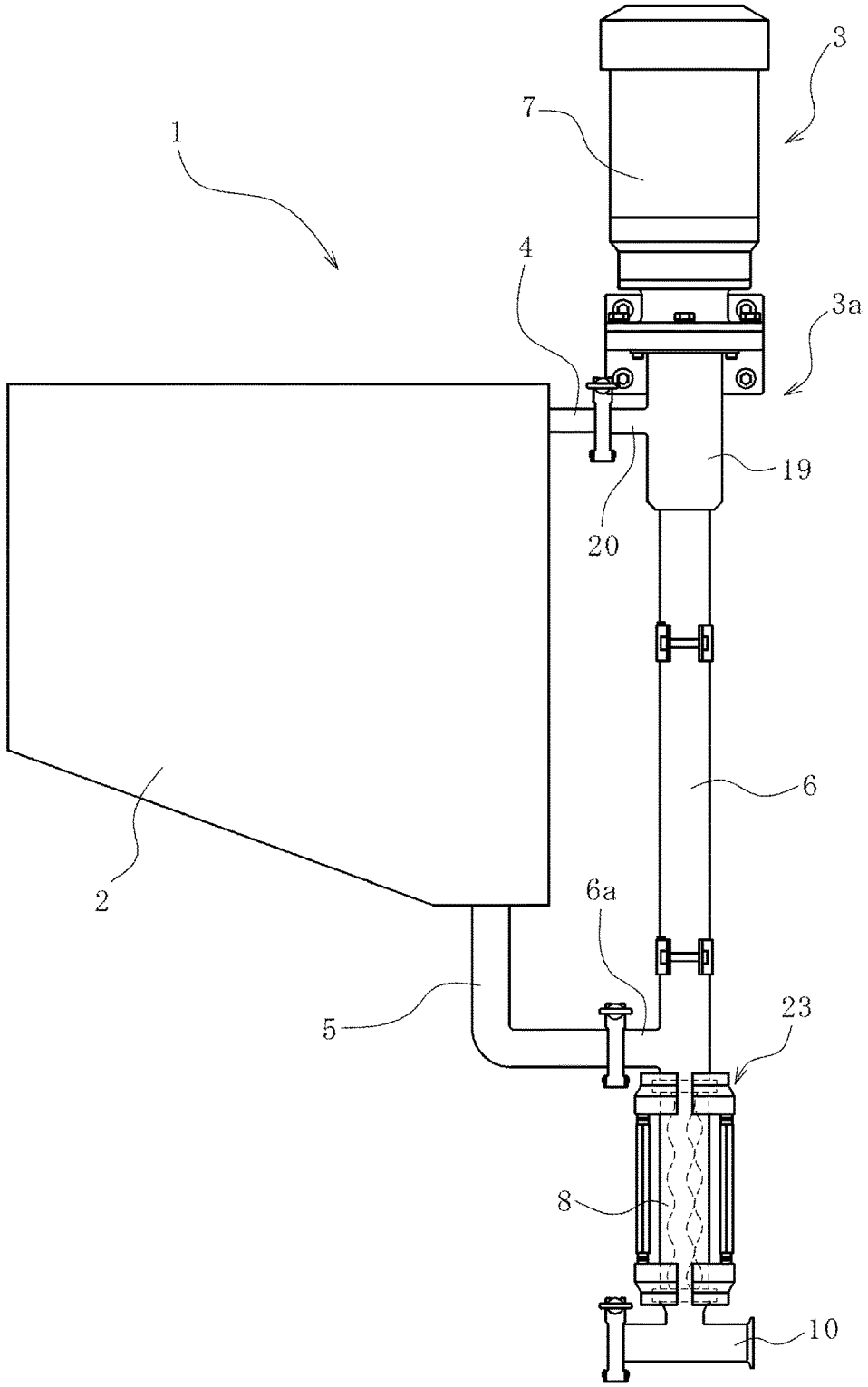
FIG. 1 is a schematic front view of a pump apparatus according to this embodiment.
Figure 2:
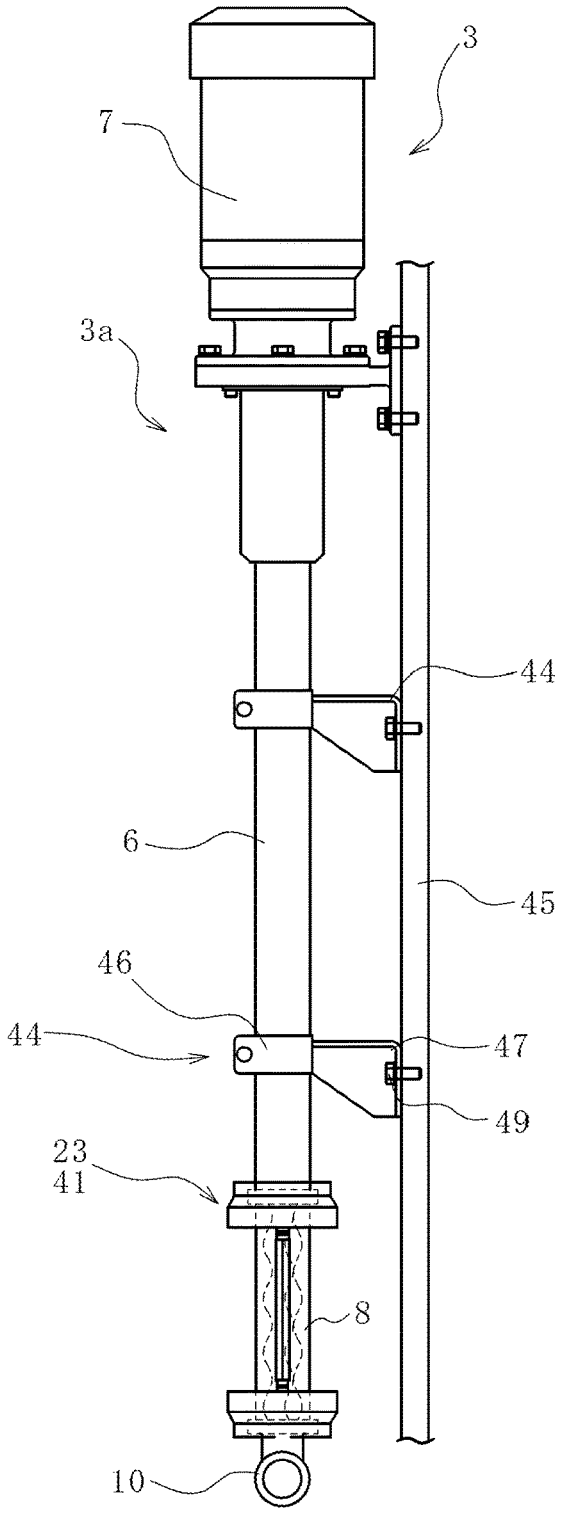
FIG. 2 is a schematic side view showing a uniaxial eccentric screw pump shown in FIG. 1.

FIG. 1 and FIG. 2 show a pump apparatus 1. The pump apparatus 1 is provided for discharging a fluid stored in a tank 2 at a fixed rate using a uniaxial eccentric screw pump 3.

The tank 2 is installed in a state where the tank 2 is supported by a support mechanism not shown in the drawing, and a fluid (a coating liquid, for example) which is a material to be conveyed is stored in the tank 2. A first connecting pipe 4 is connected to an upper portion of the tank 2. A bottom surface of the tank 2 is inclined, and a second connecting pipe 5 is connected to a portion of the bottom surface at a lowest position (lower end portion). The first connecting pipe 4 is connected to a coupling cover 19 (described later) mounted on an upper end portion of a pump casing 6 of the uniaxial eccentric screw pump 3, and the second connecting pipe 5 is connected to a lower end portion of the pump casing 6.

Figure 3:
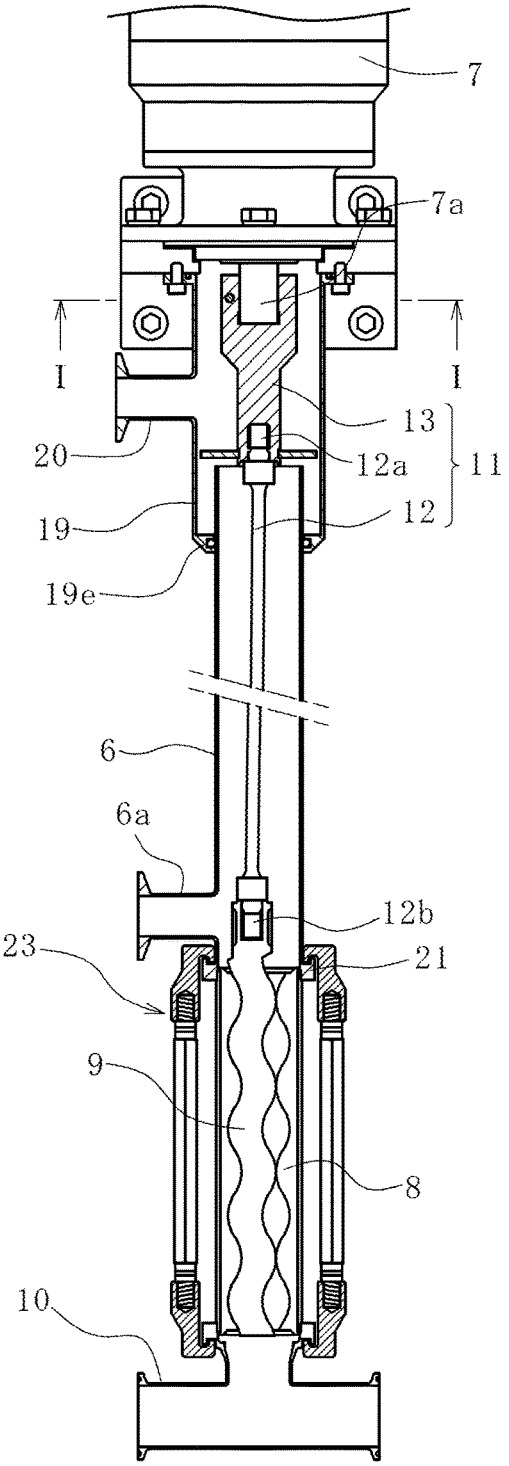
FIG. 3 is a schematic cross-sectional front view of the uniaxial eccentric screw pump shown in FIG. 2.

As shown in FIG. 3, the uniaxial eccentric screw pump 3 includes: a drive unit 7 mounted on an upper portion of the pump casing 6; a stator 8, a rotor 9 and an end stud 10 mounted on a lower end portion of the pump casing 6; and a power transmitting mechanism 11 transmitting power generated by the drive unit 7 to the rotor 9.

The pump casing 6 is a cylindrical body made of a metal material, and a communicating pipe 6*a* extends sideward from a lower side surface of the pump casing 6. The above-mentioned second connecting pipe 5 is connected to the communicating pipe 6*a*, and a coupling rod 12 is housed inside the pump casing 6. An upper end portion of the coupling rod 12 is formed of a first male threaded portion 12*a* having an outer periphery on which male threads are formed. The first male threaded portion 12*a* projects upward from an upper end opening portion of the pump casing 6, and is threadedly engaged with a coupling 13.

Figure 4:
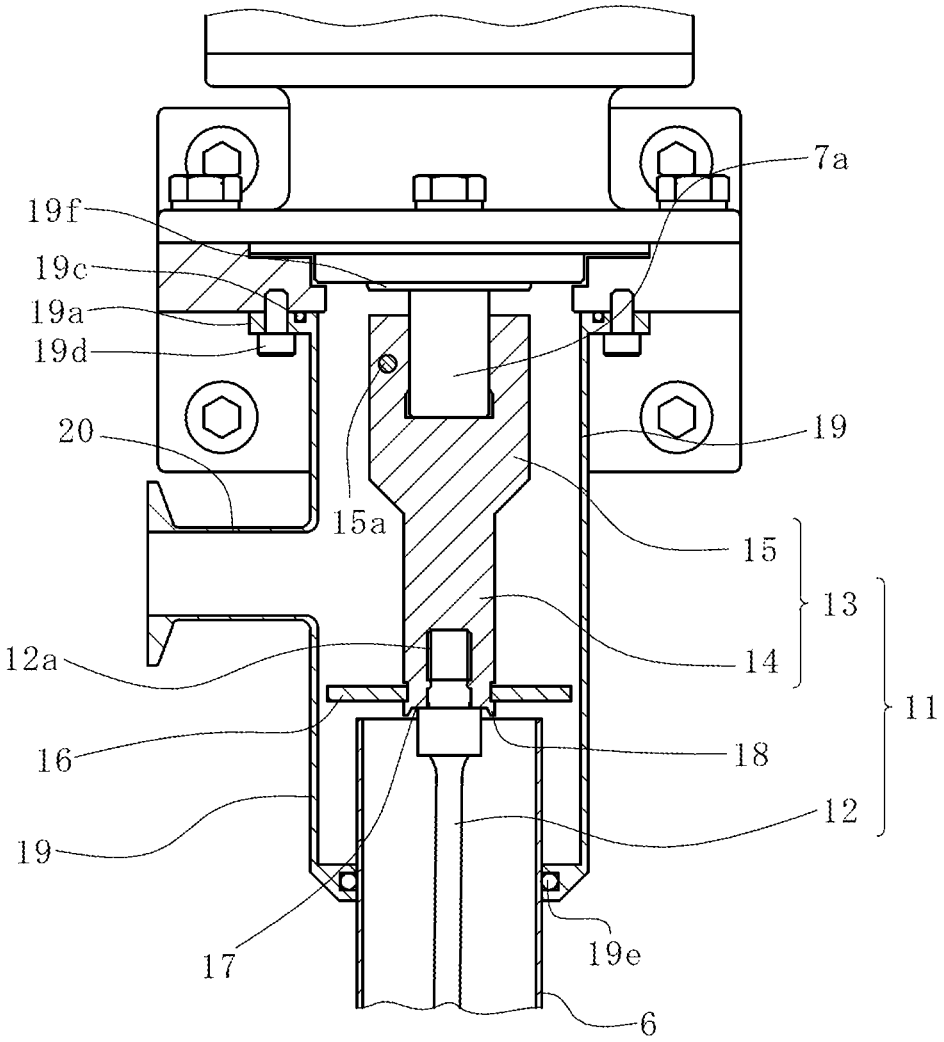
FIG. 4 is a view showing an upper portion of the uniaxial eccentric screw pump shown in FIG. 3 in an enlarged manner.
Figure 6:
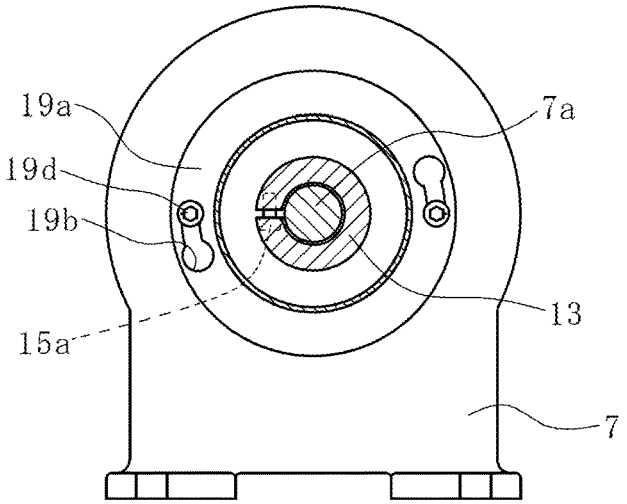
FIG. 6 is a cross-sectional view taken along a line I-I in FIG. 3.

As shown in FIG. 4, the coupling 13 is formed of: a shaft portion 14 into which the first male threaded portion 12*a* of the coupling rod 12 is threaded; and an output shaft inserting portion 15 which is fixed to an output shaft 7*a* of the drive unit 7. As shown in FIG. 6, the output shaft inserting portion 15 has an approximately C shape, and the output shaft 7*a* can be fixed to the output shaft inserting portion 15 by fastening a bolt 15*a* which is threadedly engaged with both end portions of the output shaft inserting portion 15 in a circumferential direction. An annular plate 16 is mounted on an outer peripheral surface of the shaft portion 14. That is, an annular groove is formed on the outer peripheral surface of the shaft portion 14, and the rubber-made annular plate 16 is mounted in the annular groove. A lower end portion of the shaft portion 14 projects toward a lower side from the annular plate 16, and a stepped portion 17 is formed by the lower end portion of the shaft portion 14 and the annular plate 16. An annular projecting portion 18 which projects downward is formed on an outer peripheral portion of a lower end of the shaft portion 14. Creeping up of a fluid toward the coupling 13 side due to Weissenberg effect is prevented by the annular plate 16, the stepped portion 17 and the annular projecting portion 18. In this case, creeping up of the fluid can be prevented provided that at least one of the annular plate 16, the stepped portion 17 and the annular projecting portion 18 is formed.

The coupling 13 and an upper end portion of the pump casing 6 are covered by a coupling cover 19. The coupling cover 19 is a cylindrical body made of a metal material, and a communicating pipe 20 extends sideward from an upper side surface of the coupling cover 19. A flange portion 19*a* is formed on an upper end opening portion of the coupling cover 19, and elongated holes 19*b* extending in a circumferential direction are formed in the flange portion 19*a* at two positions in point symmetry (see FIG. 6). Bolts 19*d* which are threadedly engaged with a lower end surface of the drive unit 7 in advance are made to pass through enlarged diameter portions of the elongated holes 19*b* formed in the flange portion 19*a* of the coupling cover 19, the coupling cover 19 is rotated and, thereafter, the bolts 19*d* are fastened. With such an operation, the coupling cover 19 is fixed to a lower end surface of the drive unit 7 in a state where the coupling cover 19 is brought into close contact with the lower end surface by way of a packing 19*c*. A lower end opening portion of the coupling cover 19 projects toward a radially inward side, and is brought into close contact with an outer peripheral surface of the pump casing 6 by way of a packing 19*e* mounted on an inner peripheral surface of the lower end opening portion. The first connecting pipe 4 connected to the tank 2 is connected to the communicating pipe 20. An oil seal 19*f* is mounted on a proximal portion of the output shaft 7*a* projecting from the drive unit 7. With such a configuration, it is possible to bring the inside of the coupling cover 19 into a hermetically sealed state by packings 19*c*, 19*e* and the oil seal 19*f* and hence, $N_2$ purging can be easily performed in the inside of the coupling cover 19. Further, the oil seal 19*f* per se is mounted on the drive unit 7 at the time of manufacture and hence, it is unnecessary to add a new packing. Accordingly, the structure can be simplified so that the uniaxial eccentric pump 3 can be manufactured at a low cost.

Figure 5:
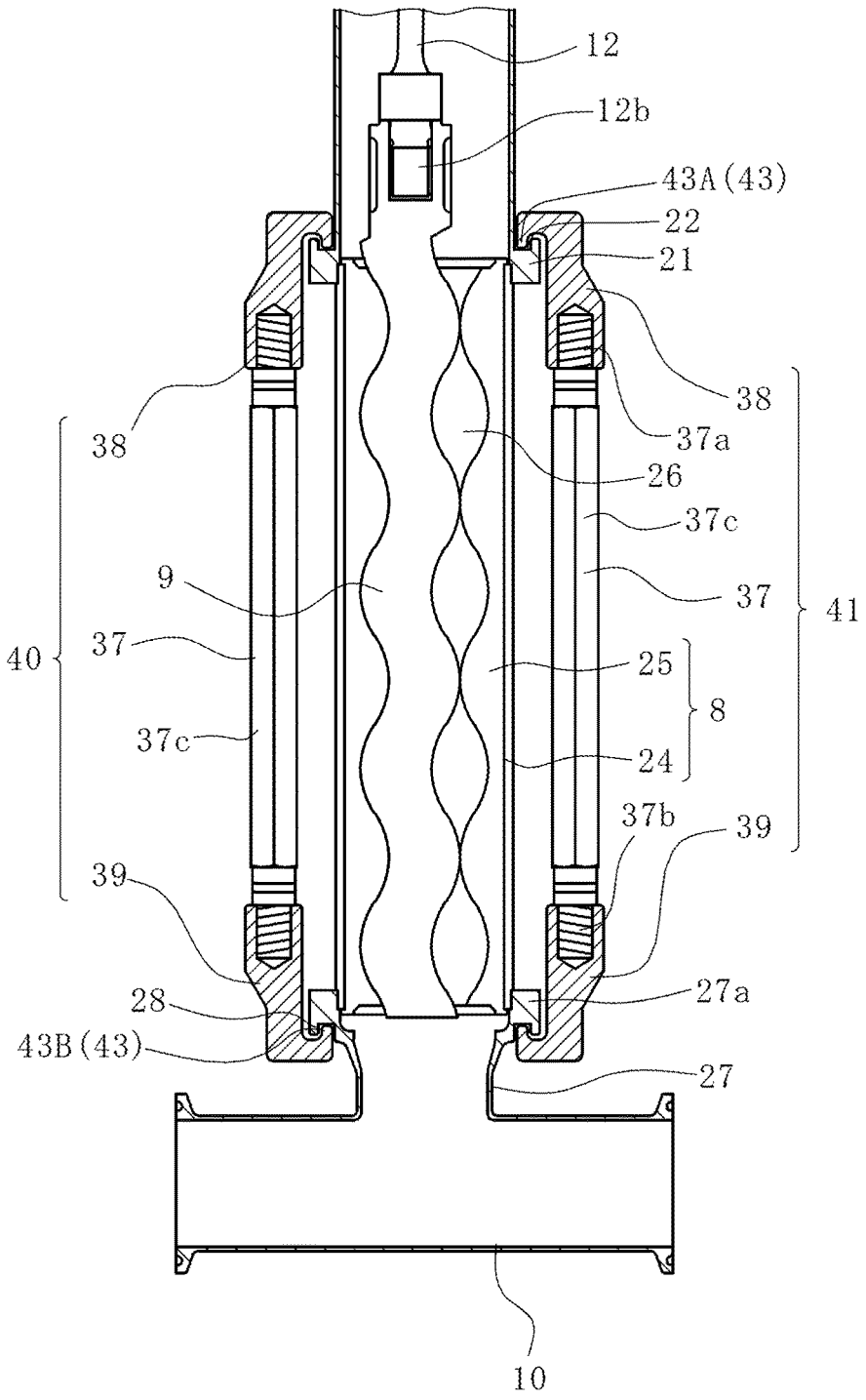
FIG. 5 is a view showing a lower portion of the uniaxial eccentric screw pump shown in FIG. 3 in an enlarged manner.

As shown in FIG. 5, a flange portion 21 which forms a first locking receiving portion is integrally formed on the lower end opening portion of the pump casing 6. A first annular groove 22 is formed on an upper surface of the flange portion 21. A first locking pawl 43A of a holder 23 described later is locked into the first annular groove 22. A lower end portion of the coupling rod 12 is positioned at a center position of the lower end opening portion of the pump casing 6. A second male threaded portion 12*b* is formed on a lower end portion of the coupling rod 12, and male threads are formed on an outer peripheral surface of the second male threaded portion 12*b*. The lower end portion of the coupling rod 12 is threadedly engaged with the rotor 9 described later.

The stator 8 is mounted on a lower end portion of the pump casing 6, and the rotor 9 to which a rotational force from the drive unit 7 is transmitted by way of the power transmitting mechanism 11 is inserted into the inside of the stator 8. The end stud 10 is disposed in a distal end portion of the stator 8. The stator 8 and the rotor 9 are held by a holder 23 in a state where the stator 8 and the rotor 9 are sandwiched between the pump casing 6 and the end stud 10.

The stator 8 is formed of: a cylindrical exterior body 24; and a stator body 25 disposed in a state where the stator body 25 is brought into a close contact with an inner surface of the exterior body 24. The stator body 25 is formed of a cylindrical body (for example, circular cylindrical body) made of an elastic material such as rubber or a resin which is selected as desired corresponding to a material to be conveyed. An inner peripheral surface of a center hole of the stator 8 is formed into a single-stage or multi-stage female threaded shape of n-thread.

The rotor 9 is formed by forming a shaft body made of a metal material into a single-axis or multi-axis male threaded shape of (n-1) threads. The rotor 9 is disposed in the inside of the center hole of the stator 8, and a continuous conveyance space 26 connected in a longitudinal direction of the center hole is formed. One end portion of the rotor 9 is connected to the coupling rod 12 on a pump casing 6 side, and the rotor 9 rotates inside the stator 8 and, at a same time, revolves along the inner peripheral surface of the stator 8 by a drive force from the drive unit 7. That is, the rotor 9 eccentrically rotates inside the center hole of the stator 8 and hence, the rotor 9 can convey a material in the inside of the conveyance space 26 in the longitudinal direction.

The end stud 10 is formed of a cylindrical body made of a metal material, and an axis of the end stud 10 extends in a horizontal direction. A communicating portion 27 which extends upward is formed in a center portion of the end stud 10, and the communicating portion 27 communicates with an opening portion of the conveyance space 26 formed by the stator 8 and the rotor 9. A flange portion 27*a* is formed on an upper end opening portion of the communicating portion 27, and a second annular groove 28 is formed on a lower surface of the flange portion 27*a*. A second locking pawl 43B of the holder 23 described later is locked into the second annular groove 28.

Figure 8:
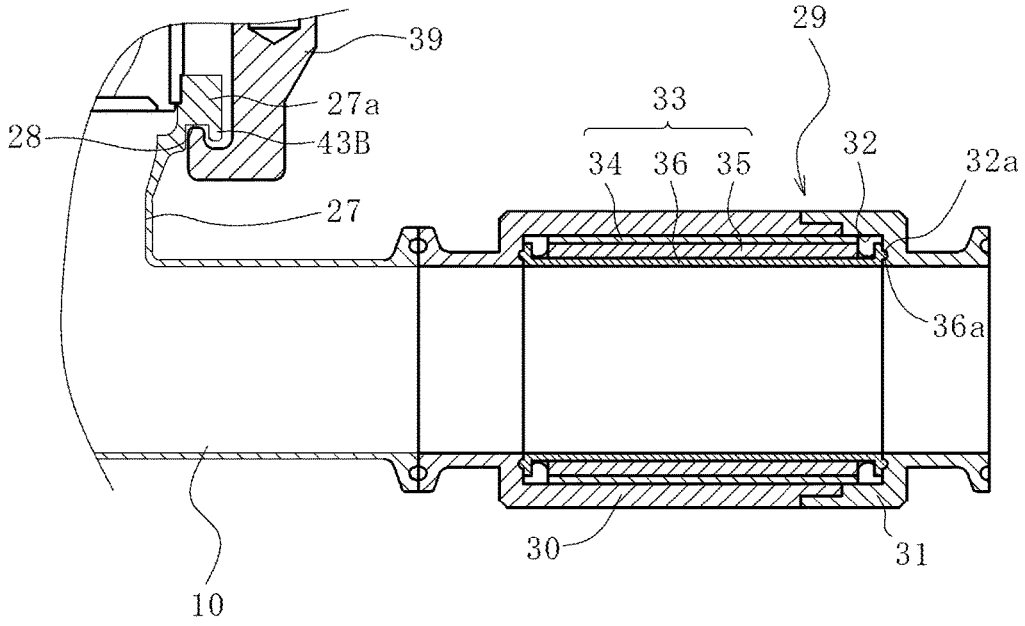
FIG. 8 is a cross-sectional view showing a portion of an end stud shown in FIG. 5 and a flow rate stabilizing member.

As shown in FIG. 8, a flow rate stabilizing member 29 is mounted on an opening of a side surface portion of the end stud 10. The flow rate stabilizing member 29 includes: a main housing 30 which has an opening portion on one end thereof which is connected to an end stud 10 side; and a support housing 31 which closes an opening portion on the other end of the main housing 30. An inner peripheral portion 32 which is defined by both housings 30, 31 has a diameter thereof enlarged toward an outer diameter side, and an annular groove 32*a* is formed on both annular end surfaces of the inner peripheral portion 32 respectively. A cylindrical elastic member 33 is disposed on the inner peripheral portion 32. The elastic member 33 is formed by adhering a sponge 35 on an inner peripheral surface of a hard sleeve 34 and by adhering a rubber tube 36 to an inner peripheral surface of the sponge 35. Annular projecting portions 36*a* positioned in the annular grooves 32*a* are formed on both end portions of the rubber tube 36, and a diameter of an inner peripheral surface of the rubber tube 36 agrees with an inner diameter size of the opening portion of the end stud 10.

With the provision of the flow rate stabilizing member 29 having such a configuration, when a flow rate of a fluid discharged from the end stud 10 changes, the rubber tube 36 and the sponge 35 are elastically deformed in an outer diameter direction corresponding to an amount of change in the flow rate of the fluid. Accordingly, provided that a change in flow rate of the fluid is extremely small, the flow rate stabilizing member 29 absorbs such a change and hence, it is possible to stabilize a flow state of the fluid after the fluid passes through the flow rate stabilizing member 29.

Figure 7:
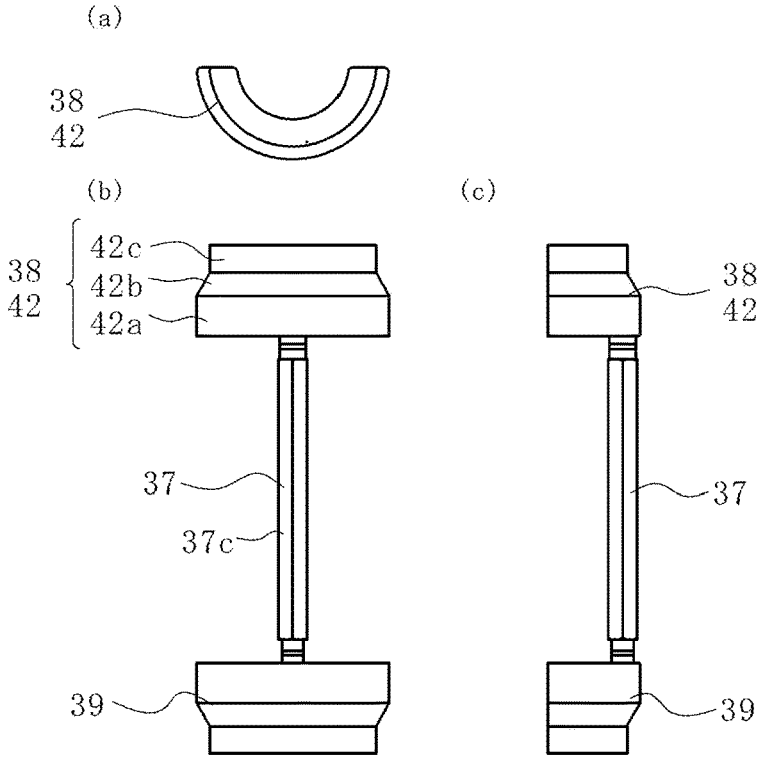
FIG. 7(*a*) is a plan view of a holder shown in FIG. 5, FIG. 7(*b*) is a front view of the holder, and FIG. 7(*c*) is a side view of the holder.

As shown in FIG. 5 and FIG. 7(*b*), the holder 23 is configured such that a first locking portion 38 and a second locking portion 39 are threadedly engaged with both end portions of stay bolts 37 which form an adjusting portion. In this embodiment, the holder 23 is formed of a first holder 40 and a second holder 41 which form a pair.

A first male thread 37*a* and a second male thread 37*b* are formed on outer peripheral surfaces of both end portions of the stay bolt 37 respectively. A threading direction of the first male thread 37*a* and a threading direction of the second male thread 37*b* are set opposite to each other. The stay bolt 37 per se is formed into a regular hexagonal shape in cross section so that three pairs of flat surfaces 37*c* are formed where each pair of flat surfaces 37*c* is parallel to an axis of the stay bolt 37. The flat surfaces 37*c* are provided for enabling the rotation of the stay bolt 37 about the axis thereof using a tool such as a wrench (not shown in the drawing). In this embodiment, the stay bolt 37 is formed of three pairs of flat surfaces which form a regular hexagonal shape. However, provided that the stay bolt 37 is configured to be rotatably operated by a tool, the stay bolt 37 may adopt any shape such as a pair of flat surfaces 37*c* (for example, flat surfaces formed partially on a center portion of the stay bolt 37), a square rod or the like.

The first locking portion 38 and the second locking portion 39 are respectively formed of a pair of semicircular portions 42 (see FIG. 7(*a*)). A cylindrical outer peripheral surface and a cylindrical inner peripheral surface are formed by the pair of semicircular portions 42. The outer peripheral surface is constituted of: a large diameter portion 42*a;* a circular conical portion 42*b;* and a small diameter portion 42*c* respectively all of which are formed toward the other end from one end of the outer peripheral surface. The inner peripheral surface is formed such that one end portion projects toward an inner side, and a distal end of one end portion is formed into an arcuate shape thus forming a locking pawl 43 which extends toward the inside in the axial direction. The locking pawl 43 (first locking pawl 43A) of the first locking portion 38 is lockable into the first annular groove 22 formed on the flange portion 21 of the pump casing 6. The locking pawl 43 (second locking pawl 43B) of the second locking portion 39 is lockable into the second annular groove 28 formed on the flange portion 27*a* of the communicating portion 27 of the end stud 10. In a state where the locking pawls 43 of both semicircular portions 42 of one locking portion 38 or 39 are locked into the annular groove 22 or 28, end portions of the semicircular portion 42 in a circumferential direction face each other or are brought into contact with each other and hence, the relative positions in the circumferential direction are decided. In this case, the locking pawls 43 (the first locking pawl 43A and the second locking pawl 43B) are formed into an arcuate shape and hence, the locking positions of the locking pawls 43 relative to the corresponding first annular groove 22 and second annular groove 28 can be set at a desired position in a rotational direction. Further, the positions of the pump casing 6 and the end stud 10 in a rotational direction can be freely adjusted and hence, the position of the communicating pipe 6*a* of the pump casing 6 and the position of a discharge port of the end stud 10 can be set at desired positions in a rotational direction.

The power transmitting mechanism 11 is formed of the coupling 13 and the coupling rod 12, and transmits a drive force of the drive unit 7 to the rotor 9.

Figure 9:
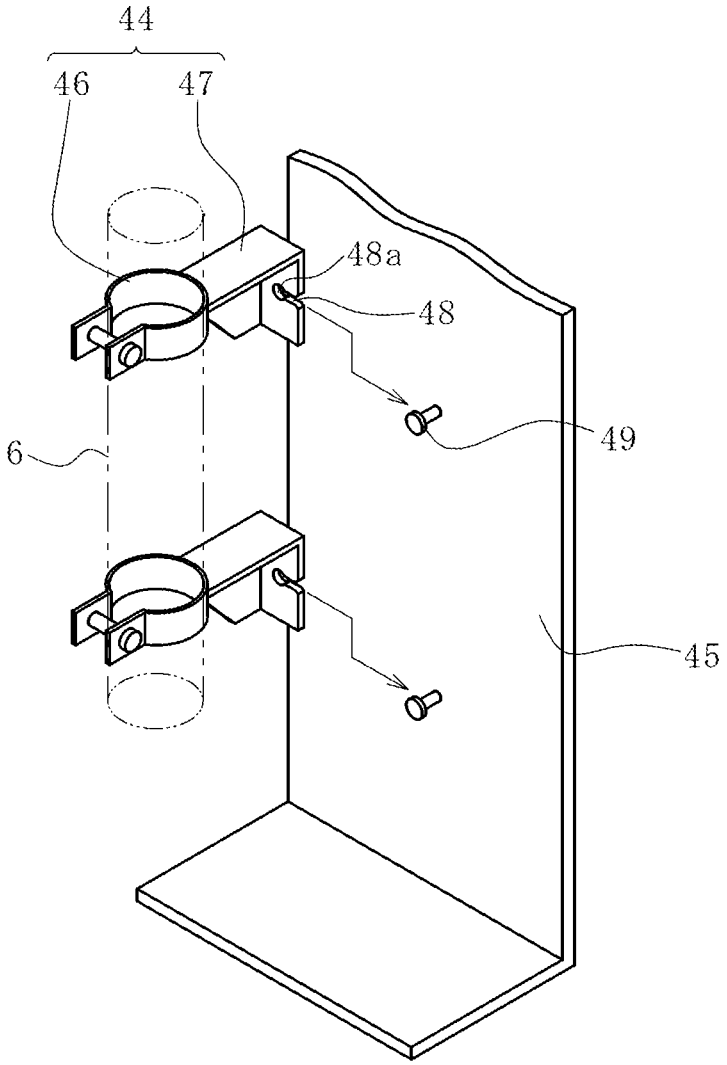
FIG. 9 is a perspective view showing the configuration for supporting the uniaxial eccentric screw pump shown in FIG. 1.

The uniaxial eccentric screw pump 3 having the above-mentioned configuration is supported by a support wall 45 by way of brackets 44 shown in FIG. 9. The bracket 44 is formed of: a clamp 46 mounted on an outer peripheral surface of the pump casing 6; and a bracket body 47 which supports the clamp 46. By fastening distal end portions of the clamp 46 by a bolt and a nut, the clamp 46 is formed into an annular shape and is brought into pressure contact with the outer peripheral surface of the pump casing 6. A notch 48 is formed in the bracket body 47 from a side edge, and has a holding hole portion 48*a* having a circularly expanded center portion. By inserting bolts 49 mounted on the support wall 45 into the notches and by fastening the bolts 49 in a state where the bolts 49 are positioned in the holding hole portions 48*a,* the uniaxial eccentric screw pump 3 can be fixed to the support wall 45 by means of the brackets 44.

Next, the manner of operation of the pump apparatus 1 having the above-mentioned configuration is described.

To discharge a fluid in the tank 2, the drive unit 7 is driven so as to rotate the rotor 9 by way of the coupling 13 and the coupling rod 12. With such an operation, the conveyance space 26 formed by the inner peripheral surface of the stator 8 and the outer peripheral surface of the rotor 9 moves in a longitudinal direction of the stator 8 and the rotor 9, that is, toward a lower side. Accordingly, the fluid discharged from the tank 2 is sucked into the conveyance space 26, and is conveyed to the end stud 10. Then, the flow direction of the fluid which reaches the end stud 10 is changed, and the fluid is further conveyed in a state where a fluid state of the fluid is stabilized by the flow rate stabilizing member 29.

In the above-mentioned pump apparatus 1, the stator 8 which is formed of an elastic material such as rubber, wears out due to slide contact with the rotor 9 while the pump apparatus 1 is used over a long time, thus giving rise to a possibility that the pump apparatus 1 cannot properly convey a fluid. In this case, the stator 8 is exchanged in the following manner.

That is, the bolt 19*d* is loosened, and the coupling cover 19 is removed from the drive unit 7 and is moved toward a lower side along the pump casing 6. Then, the bolt 15*a* is loosened so as to release a connection state between the output shaft 7*a* of the drive unit 7 and the coupling 13. Further, the connection between the first connecting pipe 4 and the communicating pipe 20, and the connection between the second connecting pipe 5 and the communicating pipe 6*a* are released respectively. At this stage of operation, the first connecting pipe 4 and the second connecting pipe 5 are closed so as to prevent a fluid from flowing out from the tank 2.

Next, the bolts 49 are loosened, the brackets 44 are moved in a horizontal direction, and a portion of the uniaxial eccentric screw pump 3 lower than the drive unit 7 (driven portion 3*a*) is removed. The removed driven part 3*a* is positioned using bolts which are mounted on the support wall 45 at another position and are substantially equal to the bolts 49. (The bolts mounted on the support wall 45 at another position are not shown in the drawing and may be configured to have no threads like pins.) This positioning is performed at an exchange position above the bolts 49. That is, to suppress an overall height of the uniaxial eccentric screw pump in a mounted state, the positioning of the driven part 3*a* by the bolts 49 is performed at a mounting position where a lower portion of the end stud 10 which is positioned at a lowermost end is disposed in the vicinity of a floor surface. Accordingly, a drawing margin for drawing the stator 8 from the rotor 9 cannot be ensured in such a mounting position. In view of the above, the driven part 3*a* is removed from the drive unit 7, and positioned above the mounting position by an amount which ensures at least a drawing margin for drawing the stator 8 from the rotor 9.

When the driven part 3*a* is positioned at the exchange position, the stay bolts 37 of the first holder 40 and the second holder 41 are rotated by a tool not shown in the drawing so as to gradually loosen a threaded state of the first locking portion 38 and the second locking portion 39 formed on both end portions of the first holder 40 and the second holder 41 respectively. At this stage of the operation, the male threaded portions 37*a,* 37*b* formed on both end portions of the stay bolt 37 have threads having opposite threading directions from each other and hence, by merely rotating the stay bolts 37, a threading state of both locking portions 38, 39 can be simultaneously loosened. Then, when a distance between the first locking portion 38 and the second locking portion 39 is increased, the first locking pawls 43A are separated from the first annular grooves 22 of the pump casing 6 and, at the same time, the second locking pawls 43B are separated from the second annular groove 28 of the end stud 10. By releasing a holding state made by the holder 23 in this manner, the end stud 10 can be removed and, at the same time, the stator 8 can be removed from the rotor 9 by moving the stator 8 downward.

Then, the rotor 9 is inserted into the center hole of a new stator 8, and the stator 8 is mounted on the pump casing 6. By locking the first locking pawls 43A of the first locking portion 38 of the holder 23 into the first annular groove 22 of the pump casing 6, the holder 23 is locked to the pump casing 6. In this state, the end stud 10 is arranged on the lower end portion of the stator 8, and the second locking pawls 43B of the second locking portion 39 of the holder 23 are locked into the second annular groove 28 formed on the flange portion 27*a*. With such an operation, the stator 8 and the end stud 10 are brought into a temporary fixed state with respect to the pump casing 6 while being guided by the holder 23. Then, the stay bolts 37 of the holder 23 are rotated by using a tool so that the first locking portion 38 and the second locking portion 39 are made to approach each other whereby a locking state by the first locking pawls 43A and the second locking pawls 43B is strengthened.

At this stage of operation, the driven part 3*a* is returned to the mounting position from the exchange position, and the driven part 3*a* is fixed to the support wall 45 by fastening the bolts 49. Then, the coupling 13 of the driven part 3*a* is connected to the output shaft 7*a* of the drive unit 7, the coupling 13 is covered by the coupling cover 19, and the coupling cover 19 is fixed to the lower end surface of the drive unit 7 by the bolt. Further, by connecting the first connecting pipe 4 and the communicating pipe 20 to each other and also by connecting the second connecting pipe 5 and the communicating pipe 6*a* to each other, the tank 2 and the pump casing 6 are returned to a communication state. With the above-mentioned operations, the exchange operation for the new stator 8 is finished.

The present invention is not limited to the configuration described in the above-mentioned embodiment, and various modifications are conceivable.

In the above-mentioned embodiment, the holder 23 is formed of the first holder 40 and the second holder 41. However, the holder 23 may be formed of one holder or may be formed of three or more holders. However, it is desirable to decide the number of holders 23 or the arrangement positions of the holders 23 such that the end stud 10 can be fixed in a stable state with a uniform strength. Further, although the holder 23 is not positioned in a rotational direction, the holder 23 can be positioned in the rotational direction. With such a configuration, the position of the stay bolts 37 rotated by a tool can be ensured and hence, the improvement of operability can be expected.

Figure 10:
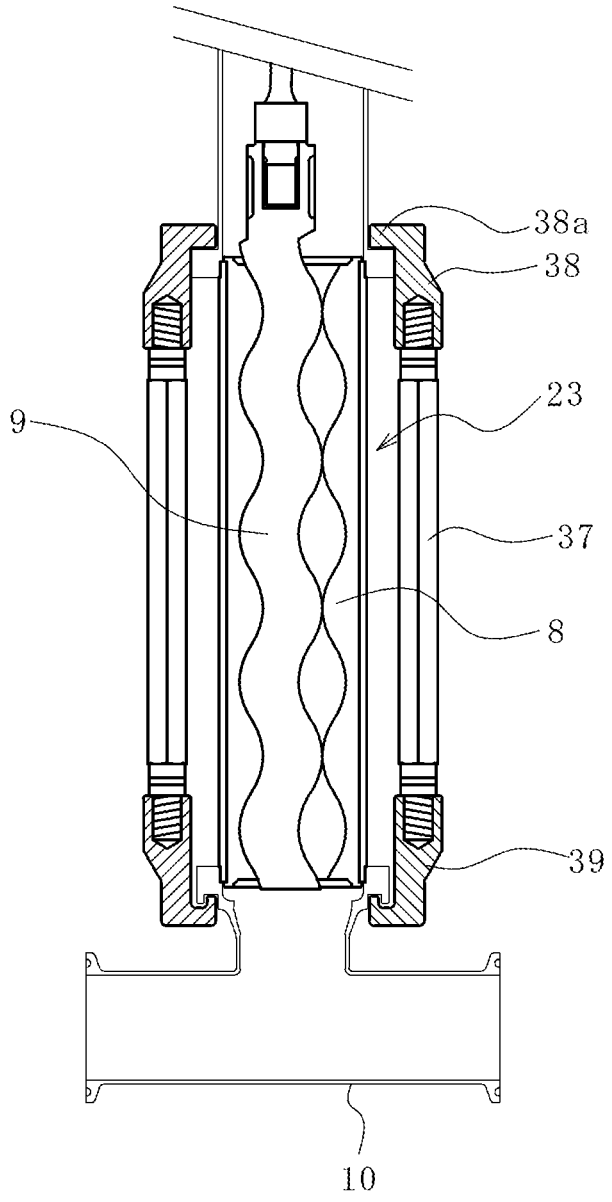
FIG. 10 is a schematic cross-sectional front view of a uniaxial eccentric screw pump according to another embodiment.

In the above-mentioned embodiment, the locking pawls 43 of the holder 23 are locked into the first annular groove 22 formed on the pump casing 6 or the second annular groove 28 formed on the end stud 10. However, for example, as shown in FIG. 10, the configuration may be adopted where a lower surface of a bent portion 38*a* having an approximately L shape is merely placed on an upper surface of a flange portion 21 of a pump casing 6. In short, provided that both end portions of the holder 23 can be locked to the pump casing 6 and the end stud 10 (or only to the pump casing 6), either one of these configurations may be adopted.

In the above-mentioned embodiment, the case is described where the uniaxial eccentric screw pump 3 is used in a vertical direction. However, even when the uniaxial eccentric screw pump 3 is used in a lateral direction, an exchange operation of the stator 8 can be easily performed using the holder 23 having the above-mentioned configuration.

Figure 11:
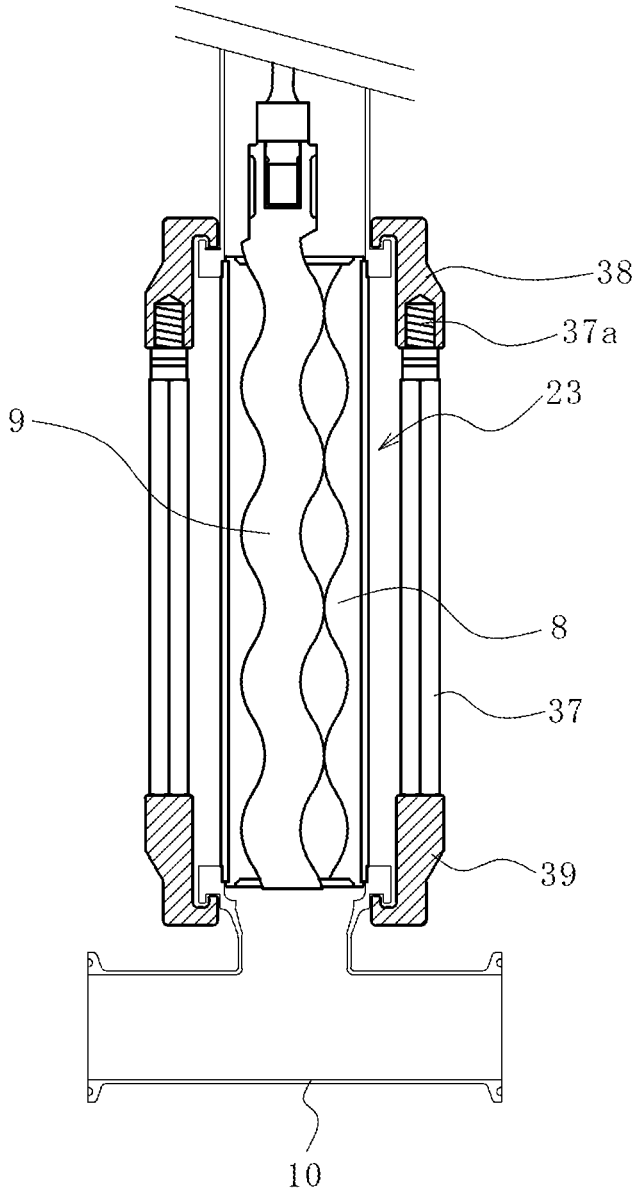
FIG. 11 is a schematic cross-sectional front view of a uniaxial eccentric screw pump according to still another embodiment.

In the above-mentioned embodiment, the first male threaded portion 12*a* and the second male threaded portion 12*b* are formed on both end portions of the coupling rod 12 respectively, and the female threaded hole is formed in the coupling 13 and the rotor 9 respectively. However, a female threaded hole may be formed on both end portions of the coupling rod 12 respectively, and a male threaded portion may be formed on the coupling 13 and the rotor 9 respectively. Further, the first male thread 37*a* and the second male thread 37*b* are formed on both end portions of the stay bolt 37 respectively, and the female threaded hole is formed in the first locking portion 38 and the second locking portion 39 respectively. However, a female threaded hole may be formed in the stay bolt 37, and a male threaded portion may be formed on the first locking portion 38 and the second locking portion 39. Further, as shown in FIG. 11, instead of forming a male threaded portion or a female threaded hole on both end portions of the stay bolt 37 respectively, a male threaded portion or a female threaded hole may be formed on only one end portion of the stay bolt 37.

DESCRIPTION OF SYMBOLS

1 Pump apparatus
2 Tank
3 Uniaxial eccentric screw pump
4 First connecting pipe
5 Second connecting pipe
6 Pump casing
6*a* Communicating pipe
7 Drive unit
7*a* Output shaft
8 Stator
9 Rotor
10 End stud
11 Power transmitting mechanism
12 Coupling rod
12*a* First male threaded portion
12*b* Second male threaded portion
13 Coupling
14 Shaft portion
15 Output shaft inserting portion
16 Annular plate
17 Stepped portion
18 Annular projecting portion
19 Coupling cover
19*a* Flange portion
19*b* Elongated hole
19*c* Packing
19*d* Bolt
19*e* Packing
19*f* Oil seal
20 Communicating pipe
21 Flange portion
22 First annular groove
23 Holder
24 Exterior body
25 Stator body
26 Conveyance space
27 Communicating portion
27*a* Flange portion
28 Second annular groove
29 Flow rate stabilizing member
30 Main housing

31 Support housing
32 Inner peripheral portion
32*a* Annular groove
33 Elastic member
34 Sleeve
35 Sponge
36 Rubber tube
36*a* Annular projecting portion
37 Stay bolt (adjusting portion)
37*a* First male thread
37*b* Second male thread
37*c* Flat surface
38 first locking portion
39 Second locking portion
40 First holder
41 Second holder
42 Semicircular portion
43 Locking pawl
43A First locking pawl
43B Second locking pawl
44 Bracket
45 Support wall
46 Clamp
47 Bracket body
48 Notch
48*a* Holding hole portion
49 Bolt

The invention claimed is:

1. A uniaxial eccentric screw pump comprising:

a casing having a first locking receiving portion;

a stator connected to the casing and having an inner peripheral surface which is formed into a female threaded shape;

a rotor being insertable into the stator and formed of a shaft body having a male threaded shape;

an end stud having a second locking receiving portion and connected to the stator on a side opposite to the casing; and a holder being configured to hold the stator between the casing and the end stud, wherein the holder includes:

a first locking portion lockable to the first locking receiving portion of the casing;

a second locking portion lockable to the second locking receiving portion of the end stud; and an adjusting portion capable of adjusting a distance between the first locking portion and the second locking portion, wherein the adjusting portion of the holder comprises:

male threaded portions formed on both end sides of the adjusting portion respectively or female threaded portions formed on both end sides of the adjusting portion respectively such that threading directions of the male threaded portions or threading directions of the female threaded portions are set opposite to each other; and a rotation operating portion formed on a middle portion of the adjusting portion.

2. The uniaxial eccentric screw pump according to claim 1, wherein the stator is arranged such that an axis of the stator agrees with a vertical direction, and the casing is arranged above the stator.

3. The uniaxial eccentric screw pump according to claim 1, wherein the first locking receiving portion is a first flange portion formed on the casing and has a first groove on a surface thereof on a side opposite to the stator, and the first locking portion has at least a first locking pawl lockable to the first groove.

4. The uniaxial eccentric screw pump according to claim 3, wherein the holder is formed of a plurality of holders, the locking pawl of the first locking portion is formed into an arcuate shape, a groove portion of the first flange portion is formed into a circular shape which allows locking of the locking pawl into the groove portion, and the locking pawls arranged adjacently to each other are brought into contact with each other in a state where the locking pawls of the respective holders are locked into the groove portion.

5. The uniaxial eccentric screw pump according to claim 4, wherein the holder is formed of two holders, and the locking pawls are formed respectively within a range of 180 degrees.

6. The uniaxial eccentric screw pump according to claim 3, wherein the holder is formed of a plurality of holders, the locking pawl of the first locking portion is formed into an arcuate shape;

a groove portion of the first flange portion is formed into a circular shape which allows locking of the locking pawl into the groove portion; and the locking pawls arranged adjacently to each other are brought into contact with each other in a state where the locking pawls of the respective holders are locked into the groove portion.

7. The uniaxial eccentric screw pump according to claim 6, wherein the holder is formed of two holders; and the locking pawls are formed respectively within a range of 180 degrees.

8. The uniaxial eccentric screw pump according to claim 3, wherein the second locking receiving portion is a second flange portion formed on one end side of the end stud and has a second groove on a surface thereof on a side opposite to the stator, and the second locking portion has a second locking pawl lockable to the second groove.

9. The uniaxial eccentric screw pump according to claim 8, wherein the holder is formed of a plurality of holders, the locking pawl of the first locking portion is formed into an arcuate shape;

a groove portion of the first flange portion is formed into a circular shape which allows locking of the locking pawl into the groove portion; and the locking pawls arranged adjacently to each other are brought into contact with each other in a state where the locking pawls of the respective holders are locked into the groove portion.

10. The uniaxial eccentric screw pump according to claim 9, wherein the holder is formed of two holders; and the locking pawls are formed respectively within a range of 180 degrees.

* * * * *